US005943958A

United States Patent [19]

Hofmann et al.

[11] Patent Number: 5,943,958

[45] Date of Patent: Aug. 31, 1999

[54] VEHICLE, IN PARTICULAR RAIL VEHICLE

[75] Inventors: Lothar Hofmann, Krefeld; Reinhold Ippers, Duisburg; Dietmar Thauer, Krefeld; Oswald Schmidt, Erlangen; Felix Mayer, Erlangen, all of Germany

[73] Assignee: Duewag Aktiengesellschaft, Krefeld, Germany

[21] Appl. No.: 09/011,077

[22] PCT Filed: Jul. 15, 1996

[86] PCT No.: PCT/DE96/01324

§ 371 Date: Jan. 27, 1998

§ 102(e) Date: Jan. 27, 1998

[87] PCT Pub. No.: WO97/05006

PCT Pub. Date: Feb. 13, 1997

[30] Foreign Application Priority Data

Jul. 28, 1995 [DE] Germany ..... 295 12 123 U

[51] Int. Cl.[6] ..... B61D 49/00

[52] U.S. Cl. ..... 105/3; 213/1.7; 213/1 R

[58] Field of Search ..... 105/3, 4.1; 213/1.3, 213/76, 1 R

[56] References Cited

U.S. PATENT DOCUMENTS 1,856,455 5/1932 Banks et al. ..... 213/1.3
3,868,909 3/1975 Pelabon ..... 213/1.3
4,794,867 1/1989 Titz ..... 105/3

FOREIGN PATENT DOCUMENTS 237 458 9/1910 Germany .
GM 1 793 336 1/1959 Germany .

OTHER PUBLICATIONS

"RegioSprinter—der neue Uerdinger Dieselleichttriebzug in Niederflurbauweise fuer den Regionalverkehr", ZEV+DEt Glasers Annalen 1995, Nr. 3 Maerz, p. 81, Fig. 1; p. 82, Fig. 2. Date Mar. 1995.

*Primary Examiner*—Mark T. Le
*Attorney, Agent, or Firm*—Michael J. Striker

[57] ABSTRACT

A rail vehicle, has at least two vehicle sections joined pivotably to one another so as to provide an intermediate space dimension to suit relative motions while traveling around curbs as well as over dips and humps, at least one line provided for each of the vehicle sections for electrical current, air or hydraulic fluid, the at least one line having a line segment that compensates a relative motion of the vehicle sections, a sleeve which spans the intermediate space between the vehicle sections, the sleeve enveloping the line and being connected to the line in a shear-resistant manner, the line segment that compensates for the relative motions of the vehicle sections outside the sleeve extending in a horizontal disposition.

13 Claims, 2 Drawing Sheets

VEHICLE, IN PARTICULAR RAIL VEHICLE

BACKGROUND OF THE INVENTION

The invention relates to a vehicle, in particular a rail vehicle, formed of at least two vehicle sections connected with each other in an articulated manner, between which there is a gap of a size to account for the relative movements when traveling through curves as well as through dips or respectively over hills, wherein at least one line for electrical current, air and hydraulic fluid extending, for example, in the top area, is associated with the vehicle sections, which has a line section for compensating the relative movements of the vehicle sections.

In known vehicles with the above mentioned features, the line section compensating the relative movements of the vehicle sections is designed as an approximately semicircular arc which either projects downward into the gap between the vehicle sections (DE-PS 237 458), or extends, pointing upward in the top area of the vehicle, over the gap (DE-GM 1 793 336; the magazine ZEV + DET Glasers Annalen 1995, No. 3, page 81, FIG. 1, and page 82, FIG. 2). With both arrangements it is necessary to maintain a minimum radius for the line section, which makes damage to the line section—for example kinks in a thicker cable—impossible in connection with any relative movements of the vehicle sections. This minimum radius can result in having to make the gap between the vehicle sections greater than necessary for the curve travel and the dip and hill travel per se. The entire vehicle becomes longer because of this, but without offering an increase in the passenger compartment. The arrangement, where the line section points upward above the vehicle top, is also considered to be unfavorable for visual and aerodynamic reasons.

SUMMARY OF THE INVENTION

It is the object of the invention to embody a vehicle of the type in accordance with the species in a simple manner in such a way that a shorter gap can be realized for the vehicle sections, wherein it is intended to protect the elastic line section against damage and to achieve a visually as well aerodynamically advantageous design.

This object is attained in accordance with the invention in that the gap between the vehicle sections is spanned by a sleeve which encloses the line and is connected with it in a shear-resistant manner, wherein the line section compensating the relative movements of the vehicle sections extends outside the sleeve in a horizontal arrangement.

In order to be able to easily compensate twisting between the vehicle sections, in an embodiment of the invention the sleeve is made of an elastic material, for example caoutchouc or PVC.

In accordance with the next embodiment of the invention, it is provided that the sleeve is fastened on the one vehicle section and is slidingly guided in respect to the other vehicle section (fixed seating and movable seating). Therefore the sleeve can only move toward one vehicle section so that, on the one hand, fastening of the sleeve in the immediate vicinity of the gap is possible and, on the other hand, the length of the slidingly guided side can be increased.

An alternative embodiment of the invention, particularly advantageous with lines of considerable diameter, resides in that the sleeve is slidingly guided in respect to both vehicle sections (two movable seatings), wherein respectively one horizontal line section compensating the relative movements of the vehicle sections adjoins both ends of the sleeve.

In regard to the longest possible wear-free use, it is provided in a further development of the invention that the sleeve has a friction-reducing coating corresponding to the length of its slide path, and/or the vehicle section has one in the area of the sliding guidance.

If it is intended to guide several lines over the gap, it is recommended in the sense of an integration to design the cross section of the sleeve oval in accordance with a supplement to the invention. A vertical strip extending in the interior of the sleeve is offered as a stiffening against bending for such a sleeve, which in particular is made of an elastic material. An additional function of the strip can be achieved in that the strip projects past at least one end of the sleeve and is equipped there for the shear-resistant connection of the line.

BRIEF DESCRIPTION OF THE DRAWINGS

The advantages which can be achieved with the subject of the invention reside in particular in that the vehicle sections can be connected particularly closely with each other, i.e. with only a short gap. This results in a reduced total length of the vehicle or, with the same length, in an enlarged passenger compartment within the vehicle sections. Advantageously, with the vehicle in accordance with the invention, the lines are furthermore reliably protected against damages and are advantageously arranged visually as well as aerodynamically.

DESCRIPTION OF PREFERRED EMBODIMENTS

Figure 1:
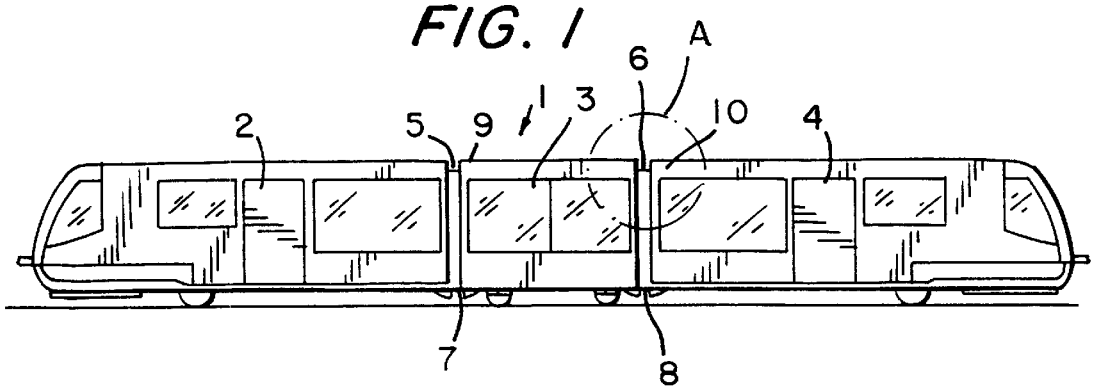
Figure 2:
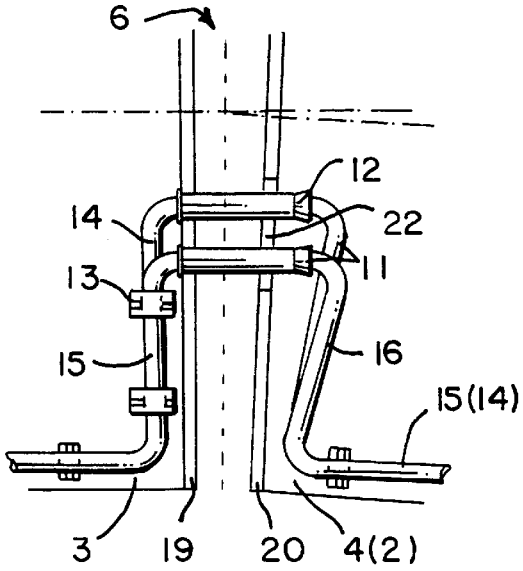
Figure 3:
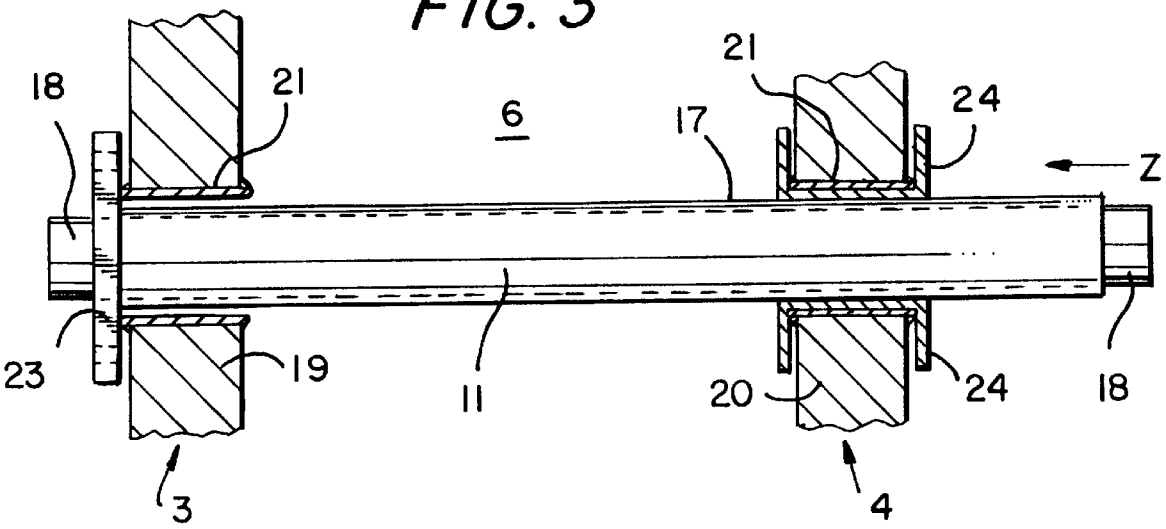
Figure 4:
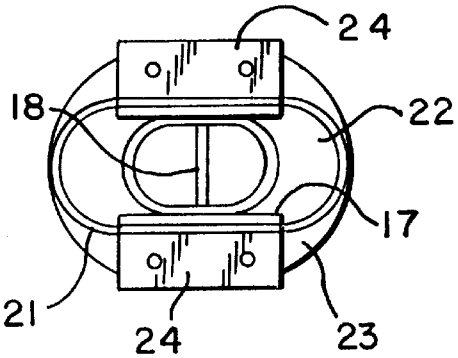

An exemplary embodiment of the invention is schematically represented in the drawings and will be described in more detail in what follows. Shown are in:

FIG. 1, a rail vehicle in a lateral view,

FIG. 2, the area A of the vehicle in FIG. 1 in a top view,

FIG. 3, the area A in FIG. 1 in an enlarged lateral view,

FIG. 4, the plan view in FIG. 3 in the direction of the arrow Z.

The vehicle 1 represented in FIG. 1 is formed of the vehicle sections 2, 3 and 4, wherein the outer sections 2 and 4 are connected in an articulated manner with the center section 3 by means of couplings 7 and 8. There are gaps 5, or respectively 6 between the vehicle sections 2 and 3 as well as 3 and 4, which are dimensioned corresponding to the relative movements during curve travel and dip and hill travel. Two lines 14 and 15 (see FIG. 2), for example, for electrical current, air or hydraulic fluid extend in the top area of the vehicle sections 2, 3 and 4, wherein line crossings 9 and 10 are provided in the area of the gaps 5 and 6. The lines 14 and 15 as well as the line crossings 9 and 10 can be placed at any arbitrary height of the vehicle 1, for example under the floor in the area of the couplings 7 and 8, either in addition to the above described arrangement in the top area, or alternatingly also as a replacement for this arrangement.

In accordance with FIG. 2, the line crossings 9 and 10 respectively contain a sleeve 11 and 12 made of an elastic material, for example caoutchouc or PVC. The sleeves 11 and 12, which are fastened on the vehicle section 3 and are slidingly guided in relation to the other vehicle section 4 (or respectively 2), enclose the lines 14 and 15, which are connected in a shear-resistant manner with the sleeves 11 and 12 and are fixed in place on the vehicle section 3 by holders 13. Elastic line sections 16, which extend in a horizontal arrangement outside of the sleeves 11 and 12 in the transverse direction of the vehicle, are used for compensating the relative movements of the vehicle sections 2, 3 and 4—for example in the curve position in FIG. 2.

FIGS. 3 and 4 illustrate a possibility for the design of the sleeve 11 (as well as of the sleeve 12), and its fastening or seating on the vehicle side. Divergent from an easily conceivable tube shape, the sleeve 11 is made oval in cross section. This oval sleeve 11 contains a vertical strip 18, which increases the dimensional stability and provides two chambers, so to speak, for housing of, for example, lines consisting of cable trees (not represented). The strip 18 projects out of the ends of the sleeve 11, so that there a shear-resistant connection of the lines can be made, for example by means of the holders 13 represented in FIG. 2, and which is easily accessible during installation.

As can be further seen from FIGS. 3 and 4, the vehicle sections 3 and 4 have end frames 19, or respectively 20, made from extruded profiled section or from sheet metal structures, which are provided with openings for the passage of the sleeve 11. Collars 21 have been welded into these openings, wherein, in view of the lateral movements of the sleeve 11, the collar 21 of the vehicle section 4 is embodied as an elongated hole 22. Fastening of the sleeve 11 on the end frame 19 of the vehicle section 3 takes place by means of a screw plate 23, which is fixedly connected with the sleeve 11, for example by gluing or vulcanizing. U-profiles 24, which have a friction-reducing coating 17 and extend around the collar 21, are used for the horizontal guidance of the sleeve 11 in respect to the vehicle section 4. The sleeve 11 is additionally provided with such a coating 17, namely over the length of its slide path in respect to the U-profiles 24 of the vehicle section 4, wherein the length of the coating approximately corresponds to one half the entire sleeve length.

Alternatively to receiving the sleeve 11 in a fixed seating (left portion of the drawing) and in a movable seating (right portion of the drawing), represented in FIG. 3, an embodiment with two movable seatings is possible. In this case the right figure portion could also be realized on the left side.

In case the vehicle sections 2, 3 and 4 are to be more frequently uncoupled during operation, there is the possibility to design the sleeve 11 to be separable in the manner of a plug connection and to employ simple round plugs for this. In that case the sleeve 11 not only takes on the function of conducting a line or several lines, but also of providing their contact.

We claim:

1. A rail vehicle, comprising at least two vehicle sections joined pivotably to one another so as to provide an intermediate space dimensioned to suit relative motions while traveling around curbs as well as over dips and humps; at least one line provided for each of said vehicle sections for electrical current, air or hydraulic fluid, said at least one line having a line segment that compensates a relative motion of said vehicle sections; a sleeve which spans said intermediate space between said vehicle sections, said sleeve enveloping said line and being connected to said line in a shear-resistant manner, said line segment that compensates for the relative motions of said vehicle sections outside said sleeve extending in a horizontal disposition, said sleeve being composed of an elastic material.

2. A rail vehicle as defined in claim 1, wherein said line extends in a region of a roof of a corresponding one of said vehicle sections.

3. A rail vehicle as defined in claim 1, wherein said sleeve is composed of rubber.

4. A rail vehicle as defined in claim 3, wherein said sleeve is composed of polyvinylchloride.

5. A rail vehicle, comprising at least two vehicle sections joined pivotably to one another so as to provide an intermediate space dimension to suit relative motions while traveling around curbs as well as over dips and humps; at least one line provided for each of said vehicle sections for electrical current, air or hydraulic fluid, said at least one line having a line segment that compensates a relative motion of said vehicle sections; a sleeve which spans said intermediate space between said vehicle sections, said sleeve enveloping said line and being connected to said line in a shear-resistant manner, said line segment that compensates for the relative motions of said vehicle sections outside said sleeve extending in a horizontal disposition, said sleeve being secured to one of said vehicle sections and being slidingly guided relative to the other of said vehicle sections; and means for slidingly guiding said sleeve.

6. A rail vehicle as defined in claim 5, wherein said means for slidingly guiding including an element selected from the group consisting of a fixed bearing and a loose bearing.

7. A rail vehicle, comprising at least two vehicle sections joined pivotably to one another so as to provide an intermediate space dimension to suit relative motions while traveling around curbs as well as over dips and humps; at least one line provided for each of said vehicle sections for electrical current, air or hydraulic fluid, said at least one line having a line segment that compensates a relative motion of said vehicle sections; a sleeve which spans said intermediate space between said vehicle sections, said sleeve enveloping said line and being connected to said line in a shear-resistant manner, said line segment that compensates for the relative motions of said vehicle sections outside said sleeve extending in a horizontal disposition, said sleeve being arranged so that it is slidingly guided relative both said vehicle sections, said sleeve having both ends adjoined by said line segment that compensates for the relative motions of said vehicle sections; and means for slidingly guiding said sleeve relative to both said vehicle sections.

8. A rail vehicle as defined in claim 7, wherein said means for slidingly guiding include two loose bearings.

9. A rail vehicle, comprising at least two vehicle sections joined pivotably to one another so as to provide an intermediate space dimension to suit relative motions while traveling around curbs as well as over dips and humps; at least one line provided for each of said vehicle sections for electrical current, air or hydraulic fluid, said at least one line having a line segment that compensates a relative motion of said vehicle sections; a sleeve which spans said intermediate space between said vehicle sections, said sleeve enveloping said line and being connected to said line in a shear-resistant manner, said line segment that compensates for the relative motions of said vehicle sections outside said sleeve extending in a horizontal disposition; and a sliding guide, said sleeve being provided with a friction-reducing coating over a length of its sliding travel in a region of said sliding guide.

10. A rail vehicle, comprising at least two vehicle sections joined pivotably to one another so as to provide an intermediate space dimension to suit relative motions while traveling around curbs as well as over dips and humps; at least one line provided for each of said vehicle sections for electrical current, air or hydraulic fluid, said at least one line having a line segment that compensates a relative motion of said vehicle sections; a sleeve which spans said intermediate space between said vehicle sections, said sleeve enveloping said line and being connected to said line in a shear-resistant manner, said line segment that compensates for the relative motions of said vehicle sections outside said sleeve extending in a horizontal disposition, and a sliding guide, at least one of said vehicle sections having a friction-reducing coating in a region of said sliding guide.

11. A rail vehicle, comprising at least two vehicle sections joined pivotably to one another so as to provide an intermediate space dimension to suit relative motions while traveling around curbs as well as over dips and humps; at least one line provided for each of said vehicle sections for electrical current, air or hydraulic fluid, said at least one line having a line segment that compensates a relative motion of said vehicle sections; a sleeve which spans said intermediate space between said vehicle sections, said sleeve enveloping said line and being connected to said line in a shear-resistant manner, said line segment that compensates for the relative motions of said vehicle sections outside said sleeve extending in a horizontal disposition, said sleeve having an oval cross-section and having at least one end arranged to be movable relative to one of said vehicle sections when said vehicle is in motion.

12. A rail vehicle as defined in claim 11, wherein said oval sleeve includes a vertical strut which increases a dimensional stability of said sleeve.

13. A rail vehicle as defined in claim 12, wherein strut protrudes passed at least one end of said sleeve and is arranged for a thrust tool connection of said line.

* * * * *